US005921318A

United States Patent [19]

Ross

[11] Patent Number: 5,921,318

[45] Date of Patent: Jul. 13, 1999

[54] METHOD AND APPARATUS FOR TREATING MULTIPLE PRODUCTION ZONES

[75] Inventor: Colby M. Ross, Carrollton, Tex.

[73] Assignee: Halliburton Energy Services, Inc., Dallas, Tex.

[21] Appl. No.: 08/837,622

[22] Filed: Apr. 21, 1997

Related U.S. Application Data

[51] Int. Cl.[6] ..... E21B 47/00; E21B 23/00; E21B 43/04

[52] U.S. Cl. ..... 166/250.17; 166/381; 166/387; 166/51; 166/126

[58] Field of Search ..... 166/250.17, 126, 166/128, 278, 51, 387, 381

[56] References Cited

U.S. PATENT DOCUMENTS

| | | | |
|---|---|---|---|
| 3,062,284 | 11/1962 | Brown | 166/19 |
| 3,153,451 | 10/1964 | Chancellor et al. | 166/51 |
| 3,335,802 | 8/1967 | Seyffert, III | 166/226 |
| 3,421,586 | 1/1969 | Solum | 166/51 |
| 3,517,743 | 6/1970 | Pumpelly et al. | 166/127 |
| 3,606,926 | 9/1971 | Schwegman | 166/315 |
| 3,637,010 | 1/1972 | Maly et al. | 166/51 |
| 3,698,477 | 10/1972 | Radig et al. | 166/214 |
| 3,710,862 | 1/1973 | Young et al. | 166/278 |
| 3,726,343 | 4/1973 | Davis, Jr. | 166/278 |
| 3,768,562 | 10/1973 | Baker | 166/289 |
| 3,845,815 | 11/1974 | Garwood | 166/154 |
| 3,856,082 | 12/1974 | Dinning | 166/154 |
| 3,901,318 | 8/1975 | Fortenberry | 166/278 |
| 3,913,676 | 10/1975 | Barbee, Jr. et al. | 166/278 |
| 3,926,409 | 12/1975 | Abney et al. | 251/344 |
| 3,948,322 | 4/1976 | Baker | 166/289 |
| 3,952,804 | 4/1976 | Smyrl | 166/278 |
| 3,963,076 | 6/1976 | Winslow | 166/278 |
| 3,987,854 | 10/1976 | Callihan et al. | 166/278 |
| 4,044,832 | 8/1977 | Richard et al. | 166/278 |
| 4,049,055 | 9/1977 | Brown | 166/278 |
| 4,105,069 | 8/1978 | Baker | 166/51 |
| 4,192,375 | 3/1980 | Maly et al. | 166/51 |
| 4,270,608 | 6/1981 | Hendrickson et al. | 166/278 |
| 4,401,158 | 8/1983 | Spencer et al. | 166/51 |
| 4,440,218 | 4/1984 | Farley | 166/51 |
| 4,474,239 | 10/1984 | Colomb et al. | 166/278 |
| 4,540,051 | 9/1985 | Schmuck et al. | 166/278 |
| 4,541,486 | 9/1985 | Wetzel et al. | 166/297 |
| 4,606,408 | 8/1986 | Zunkel et al. | 166/278 |
| 4,627,488 | 12/1986 | Szarka | 166/51 |
| 4,840,229 | 6/1989 | Proctor et al. | 166/381 |
| 4,858,690 | 8/1989 | Rebardi et al. | 166/278 |
| 4,858,691 | 8/1989 | Ilfrey et al. | 166/278 |
| 5,145,004 | 9/1992 | Cornette | 166/278 |
| 5,443,117 | 8/1995 | Ross | 166/51 |
| 5,577,559 | 11/1996 | Voll et al. | 166/278 |
| 5,597,040 | 1/1997 | Stout et al. | 166/51 |
| 5,609,204 | 3/1997 | Rebardi et al. | 166/51 |
| 5,620,050 | 4/1997 | Barbee | 166/278 |

*Primary Examiner*—Thomas B. Will
*Assistant Examiner*—Gary S. Hartmann
*Attorney, Agent, or Firm*—William M. Imwalle; Shawn Hunter

[57] ABSTRACT

The method and apparatus for treating multiple production zones includes a completion string having a plurality of sets of tools including a closing sleeve, indicator collar, and production screens with an isolation packer disposed between each adjacent set. An inner service tool is disposed within the outer completion string and includes an upper portion with a crossover tool and a lower portion with a closing sleeve shifter and a weight-down collet with the upper and lower portions being connected. The apparatus is assembled by assembling an initial length of the outer completion string which does not includes any of the closing sleeves or indicator collars. After the initial length is assembled, the lower portion of the service tool with the closing sleeve shifter and weight-down collet are assembled and inserted into the initial length of completion string. The remainder of the completion string is then assembled with all closing sleeves in the closed position. The upper portion of the service tool is then assembled and stabbed and connected into the lower portion. As multiple production zones are treated, the inner service tool is raised and then lowered opening a closing sleeve and setting weight on the indicator collar. A predetermined amount of weight is then maintained during the operation to ensure that the crossover tool is positioned adjacent the opened closing sleeve. The production zone then may be treated in the weight-down position.

20 Claims, 7 Drawing Sheets

METHOD AND APPARATUS FOR TREATING MULTIPLE PRODUCTION ZONES

BACKGROUND OF THE INVENTION

The present invention relates to a method and apparatus for gravel packing, frac packing or other treatment of a production zone and more particularly for gravel packing, frac packing or other treating of multiple production zones with one trip of the apparatus into the well.

During the production of hydrocarbons from a well, loose sand and degraded sandstone migrate into the wellbore as the formation deteriorates under the pressure and flow of fluids. This migration of particles may eventually clog the flow passages in the well. One method of controlling migration into a wellbore is the placing of a pack of gravel on the exterior of a perforated or slotted liner or screen which is positioned across from the producing formation to present a barrier to the migrating sand while permitting hydrocarbon flow. The gravel is carried to the formation in the form of a slurry, the carrier fluid being removed and returned to the surface. The gravel is packed around an inner liner or screen which maintains the gravel around the exterior of the screen and the slurry fluid enters the liner or screen from its exterior for flow back to the surface or is forced into the formation.

In a typical gravel packing operation, a liner assembly having a perforated liner or screen is disposed within a perforated casing and positioned adjacent the formation. A packer is set above the zone between the liner and the well casing. A tubing string is run inside the liner assembly at the area of the zone. Gravel slurry is pumped down the tubing string and through a crossover tool and out into the annulus between the liner and the casing below the packer at a suitable location above the zone where it descends and the gravel is deposited in the area of the screen as the carrier fluid passes through the screen. The crossover tool routes the upward movement of the returning fluid back outside the liner assembly, the fluid then traveling up to the surface. Once a pressure build up is noted at the surface, the flow of gravel-laden fluid is stopped. After the gravel packing is completed, the tool is generally moved and the circulation of fluid is reversed, a clean fluid being pumped down the casing annulus and back up the tubing in order to flush out sand remaining in the tubing. Subsequently, the well may be subject to other treatments, if necessary, and produced. One such treatment may be fracturing the well. Patents disclosing different methods of gravel packing include U.S. Pat. Nos. 3,710,862; 3,952,804; and 4,044,832.

In gravel packing wells having multiple production zones, it is desirable to utilize a method and apparatus which has the capability of gravel packing the multiple zones in a single trip into the well. See for example, U.S. Pat. Nos. 4,105,069 and 4,270,608.

Some prior art methods and apparatus for gravel packing multiple zones require that the operating string trip into the well for each producing zone. The outer string, containing the packing screens, are assembled from the bottom up in a step by step process and then the operator must withdraw the operating string between zones in order to add components to the outer string. This also renders it impossible to pack an upper zone before a lower zone, or to set or inflate packers in any order other than the lowest packer first. Because of the order in which the zones are packed, it is almost impossible to repack zones below the uppermost zone. In some instances, this is due to an inability to place the operating string back in the desired location, due to restrictions placed in the outer string after packing a zone. In other cases it is due to an inability to relocate the desired zone and to position the gravel ports with any precision.

A conventional multi-zone packing system includes an outer completion string having a production packer with slips for supporting the completion string within the cased well. Disposed below the production packer is an upper closing sleeve and an upper zone screen. An isolation packer is disposed below the upper zone screen and a lower closing sleeve and a lower zone screen which are disposed below the isolation packer. A first seal bore is disposed between the production packer and upper closing sleeve and a second seal bore is disposed between the upper closing sleeve and upper zone screen. A third seal bore is disposed between the upper zone screen and isolation packer and a fourth seal bore is disposed at the lower zone screen. A sump packer is disposed below the lower zone screen around a lower seal assembly. In the case of an open hole, inflatables would be used in place of the sump packer and isolation packers. An inner service tool includes a plurality of seal units forming an outer conduit and an inner center tube. The center tube and seal units form an annulus extending from upper ports in the uppermost seal unit to lower crossover ports extending through the outer conduit formed by the seal units and center tube. An additional length of seal units extends from the crossover ports downwardly for several feet followed by an extension and an additional set of seal units to a ported sub and lower seal assembly at its lower end. To be able to open and close the closing sleeves, the service tool includes at least two shifting tools, one above the crossover tool and one below. A single shifting tool may be used but it must be located very close to the gravel pack ports so that the shifting tool can be raised a very short distance, close the closing sleeve, and still have the gravel pack ports within the short distance range. An upper ball check is provided at the lower terminal end of the center tube to prevent downward flow through the flowbore of the center tube. A lower check valve is provided in the conduit of the seal units to prevent the downward flow of fluids in the annulus and into the flowbore formed by those seal units disposed below the crossover ports. Another ball check valve is provided at the lower terminal end of the seal units.

In operation, the sump packer is lowered into the well and set by a wire line at a predetermined location in the well below the zones to be produced. The completion string is then assembled at the surface starting from the bottom up until the completion string is completely assembled and suspended in the well up to the packer at the surface. Then, the inner service tool is assembled and lowered into the outer completion string. The service tool includes one or more shifting tools, depending upon the number of production zones, for opening and closing the closing sleeves. When the service tool is lowered into the completion string, the shifting tool opens all of the closing sleeves in the completion string. Therefore, it does not matter whether the closing sleeves were initially in the open or closed position since the shifting tools will move them all to the open position as they pass downwardly through the completion string. These sleeves later must be moved to the closed position to set the isolation packer. The packer assembly and setting tool are then attached to the upper ends of the service tool and completion string and the entire assembly lowered into the well on a work string onto the sump packer. Upon aligning the zone screens with the production zones, the production packer is set to suspend the completion string within the cased well.

In gravel packing the lower production zone, the setting tool is disconnected from the completion string and is raised such that the set of upper seals no longer engages the first seal bore of the production packer. At that time, the seals on the upper seal units sealingly engage the first, third, and fourth seal bores and the crossover ports are adjacent the lower closing sleeve which is open. In order to set the isolation packer, the lower closing sleeve must be closed utilizing a shifting tool in the service string so that the annulus between the closing sleeve and the outside of the service tool may be pressurized to set the isolation packer.

Gravel slurries are then pumped down the flowbore of the work string and center tube. The ball check valve directs the gravel through the crossover ports and through the open lower closing sleeve and into the lower annulus. The gravel builds in the lower annulus adjacent the sump packer with the returns flowing through the lower zone screen and ported sub. The returns flow up the flowbore of the lower seal units and through the lower ball check valve. The returns then pass through the bypass apertures around the crossover ports and up the annulus. The returns thereafter flow out through the upper ported sub and up the upper annulus formed by the work string and outer casing. Upon completing the gravel pack of the lower production zone, fluids are reverse circulated down to the crossover ports. Fluid is then pumped down the annulus between the work string and casing, through the upper ported sub at the upper end of the seal units, down the annulus, and through the bypass apertures around the crossover ports. The lower ball check prevents the fluid from passing down into the flowbore of the lower seal units and directs the flow through upper ball check and flowbore to the surface.

In gravel packing the upper production zone, the service tool is raised such that the crossover ports are adjacent the upper closing sleeve. Also, the seals on the seal units sealingly engage the first, second, and fourth seal bores. Circulation and reverse circulation occurs substantially as previously described with respect to the lower production zone.

In a gravel pack operation for three or more production zones, upper and lower shifting tools are used with one of the shifting tools being in the service tool and the other in the wash pipe. The shifting tools on the service tool push the closing sleeves to the down or open position as they pass through the completion string. Then, the upper shifting tool is raised through the upper closing sleeve to pull the upper closing sleeve to its upper or closed position. Once the upper closing sleeve has been closed, the gravel pack ports are placed in position to pressure up the annulus and set the isolation packer. This procedure requires that the service tool be raised and then lowered back down to reopen the sleeve but not lower the upper shifting tool through the closing sleeve. This creates a lot of movement up and down to get the closing sleeve in the proper position.

In a gravel pack operation for a dual zone, it is possible to use only one shifting tool. However, in utilizing only one shifting tool, it is necessary to space the shifting tool very close to the gravel pack ports such that the shifting tool can be raised through the closing sleeve to pull the sleeve closed and yet not raise the gravel pack ports so high that the gravel pack ports are moved above the seal bore of the isolation packer so as to prevent pressuring up to set the isolation packer. This requires a very short reciprocal motion thereby requiring that the service string be spaced out very accurately with respect to the completion string. Another problem with locating the closing sleeve and shifting tool so close to the gravel pack ports is that the gravel pack sand tends to get into and around the keys of the shifting tool, locking up the keys so that they will not function properly. Further, the use of a single shifting tool is useful for relatively shallow, straight wells. However, when gravel packing deep wells or highly deviated wells where the pipe making up the work string has high movement, the operator has difficulty knowing whether the gravel pack ports are properly positioned adjacent the closing sleeve.

Another disadvantage of the prior art is that the prior art method and apparatus does not permit performing the gravel pack in a weight-down position which is preferred in the industry. The work string is made up of steel tubing which will contract and expand in the well, particularly when the work string is several thousand feet long. At such lengths, the steel stretches causing the lowermost end of the work string to move several feet within the well. This is particularly a problem in gravel packing operations when it is necessary to position the gravel pack ports accurately across from the closing sleeves.

It is also advantageous to perform other operations, such as hydraulic fracturing, in a weight-down position. The work string extending from the top of the service tool to the surface has substantial movement during a fracturing or fracpac operation. The movement of the work string is even more exaggerated than during a gravel pack operation due to the thermal effects caused by the cool fracturing fluid being pumped down through the work string at a very high rate. This tends to cause shrinkage in the work string. Further, the work string tends to balloon due to the increased pressure within the work string which also causes the work string to shrink. These combined affects tend to shorten the work string substantially during the operation.

Although a weight indicator is used at the surface to determine the amount of weight hanging off the crown block, the fact that the weight appears to be staying the same does not provide an indication as to whether the length of the work string is changing at its lower end. If the work string shrinks several feet, the gravel pack ports may be raised a distance so as to cause the gravel pack ports to be moved up into the packer seal bore and prematurely end the operation.

Another problem during the frac pack operation is that the pumping of the fluid through the work string at a very high rate causes a vibration in the work string thereby causing it to move up and down. With a very long work string, this reciprocable motion may get very large causing it to bounce up and down within the well such that it may act like a spring.

The present invention overcomes the deficiencies of the prior art.

SUMMARY OF THE INVENTION

The method and apparatus of the present invention for individually treating a plurality of production zones with one trip into the well includes a completion string having a plurality of sets of closing sleeves, indicator collars, and screens with an isolation packer disposed between each adjacent set. An inner service tool is disposed within the outer completion string and includes an upper and lower portion connected by a connection such as a pin and box or latch. Typically, the upper portion includes a cross-over tool and the lower portion includes a closing sleeve shifter and weight-down collet. The completion string and service tool are assembled by assembling an initial length of the outer completion string which does not include any closing sleeve or indicator collar. After the initial length of completion string is assembled, the lower portion of the service tool which includes the closing sleeve shifter and weight-down collet are assembled and inserted into the initial length of completion string. The remainder of the completion string is then assembled with all closing sleeves in the closed position. Upon completing the assembly of the completion string, the upper portion of the service tool is assembled and stabbed into the lower portion and connected thereto at the connection. Alternatively, the cross-over tool can be located in the lower portion and with lower portion initially suspended within the outer completion string by a latch. After the completion string is assembled within the well, a work string is attached by the latch to the lower portion and the lower portion is raised within the completion string. The latch is then removed from the lower portion and the sections of the upper portion are then assembled to the lower portion. This later method eliminates the need to leave the connection in the inner service tool.

In treating multiple production zones, the lowermost isolation packer is set on the completion string and then the inner service tool is raised allowing the closing sleeve shifter to pass through the lowermost closing sleeve and the weight-down collet to pass through the lowermost indicator collar. The service tool is then lowered back down causing the closing sleeve shifter to open the closing sleeve and allowing the weight of the service tool and work string to be set down on the support shoulder of the indicator collar. The operator at the surface monitors the weight on the indicator collar and selectively adds or reduces weight on the indicator collar to maintain the crossover tool in position with the lowermost, now opened, closing sleeve. Upon completing the treatment of the lowermost production zone, the inner service tool is raised to the next uppermost production zone and the procedure repeated.

One object of the present invention is to have the capability of gravel packing multiple zones in a multiple zone completion string with a single trip into the well of the service tool and also have the ability to set weight-down on the completion string during the treatment of the production zones.

Another advantage is that only one closing sleeve shifter is required. Closing sleeve shifters have a tendency to get stuck within the completion string. Thus, it is advantageous to not only limit the number of shifters to a single closing sleeve shifter but also limit the movement of the closing sleeve shifter within the completion string such as raising and lowering the closing sleeve shifter to open and close various closing sleeves. The present invention provides a single closing sleeve shifter which only has limited movement within the completion string.

Still another object of the present invention is to be able to perform a frac packing operation after the gravel packing operation and allow a substantial amount of the weight of the service tool and work string to be placed on the completion string to maintain the service tool in a predetermined position with respect to each of the multiple production zones and prevent the service tool from drifting during the movement of the work string associated with the high pressures caused by the fracturing operation and to prevent vibration of the service tool downhole causing the service tool to wear out. By allowing weight-down, the service tool will maintain its position to ensure that the crossover ports are properly aligned with the apertures through the closing sleeves for each of the multiple zones.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF A PREFERRED EMBODIMENT

Figure 1:
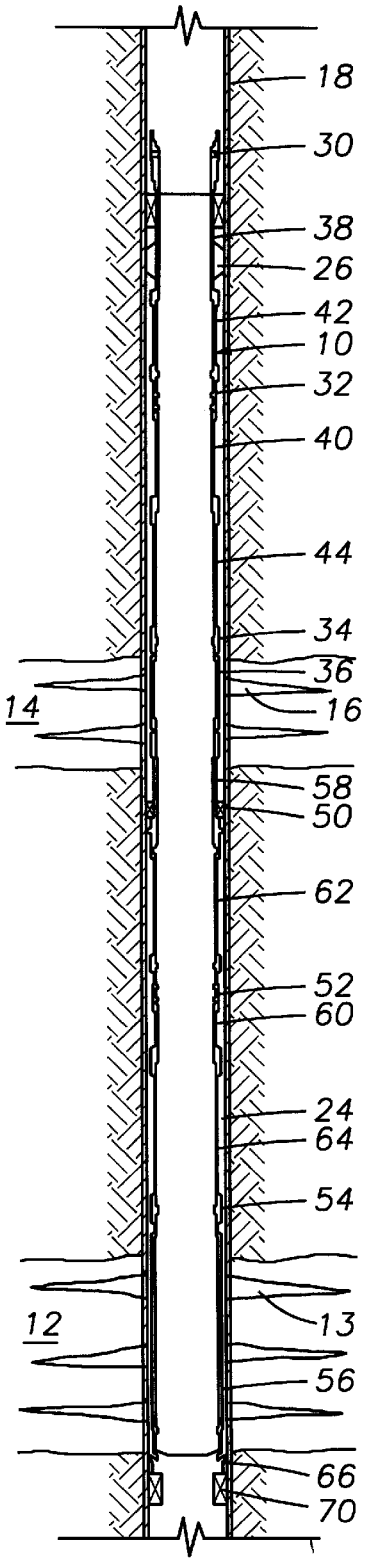
FIG. 1 is a simplified schematic of a vertical cross-sectional elevation view of the completion string disposed within a cased well.

Referring initially to FIG. 1, a completion string 10 is shown for a dual zone completion with a production packer 30 at its upper end having slips 26 for supporting completion string 10 within an outer casing 18. Casing 18 is disposed within a well having a plurality of production zones, such as lower zone 12 and upper zone 14 having perforations 13, 16, respectively, for the passage of hydrocarbons from zones 12, 14 into the annulus 24 formed between completion string 10 and outer casing 18. The completion string 10 includes a plurality of sets of tools with an isolation packer disposed between each set. A set of tools includes an upper seal bore, a closing sleeve, a lower seal bore, an indicator collar, and a plurality of screens. Thus there is an upper set for the upper zone and a lower set for the lower zone in a dual zone completion.

The upper zone set of tools is disposed below production packer 30 and includes upper zone upper closing sleeve 32, an upper zone indicator collar 34, and an upper zone screens 36. An upper zone upper seal bore 38 is disposed between production packer 30 and upper zone upper closing sleeve 32 and an upper zone lower seal bore 40 is disposed between upper zone upper closing sleeve 32 and upper zone screen 36. Pup extensions 42, 44 extend between upper seal bore 38 and upper closing sleeve 32 and between lower seal bore 40 and indicator collar 34, respectively.

An isolation packer 50 is disposed between the adjacent upper and lower zone sets of tools. The lower zone set includes a lower zone lower closing sleeve 52, a lower zone indicator collar 54, and lower zone screens 56 being disposed below isolation packer 50. A lower zone upper seal bore 58 is disposed adjacent isolation packer 50 and a lower zone lower seal bore 60 is disposed between lower zone lower closing sleeve 52 and lower zone indicator collar 54.

Pup extensions 62, 64 extend between isolation packer 50 and lower zone lower closing sleeve 52 and between lower zone lower seal bore 60 and lower zone indicator collar 54, respectively. The lower terminal end of completion string 10 includes a seal assembly 66 which is received by a sump packer 70.

Figure 2:
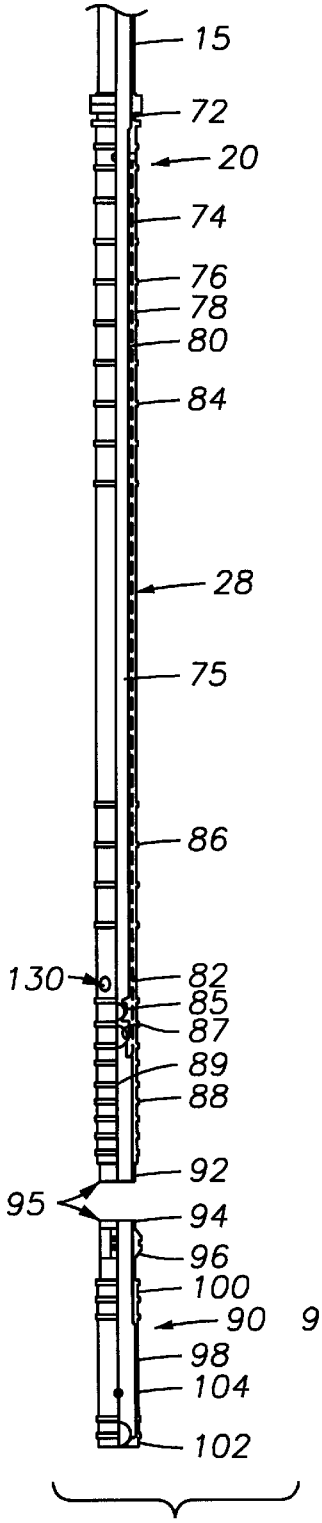
FIG. 2 is a simplified schematic of a vertical cross-sectional elevation view of the service tool of the present invention.
Figure 3:
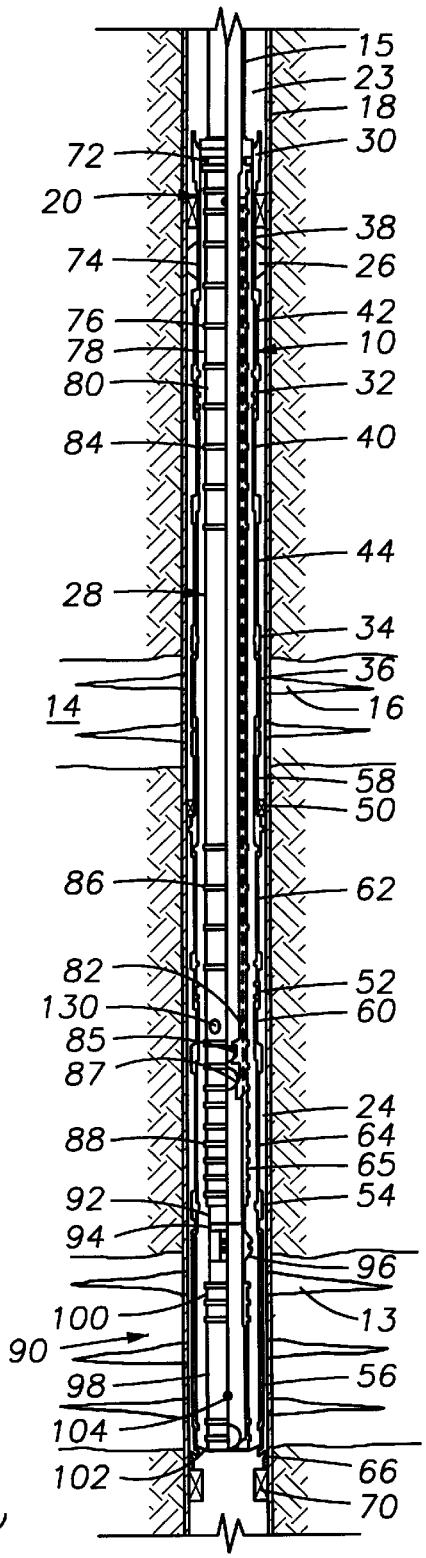
FIG. 3 is a simplified schematic of a vertical cross-sectional elevation view of the service tool shown in FIG. 2 disposed within the completion string shown in FIG. 1.

It should be appreciated that although the completion string 20 shown in FIGS. 1–3 includes only upper and lower zone sets of tools with an isolation packer disposed therebetween, additional sets of tools may be included with the completion string for gravel packing or otherwise treating additional production zones and that the present invention is not limited to treating only two production zones. As additional sets of tools are added to the completion string 10, an additional isolation packer is disposed between each additional adjacent set. The present invention may be used to complete any number of production zones with one trip into the well.

Referring now to FIG. 2, a service tool 20 includes an upper portion, generally designated 28, and a lower portion, generally designated 90. A setting tool 72 and work string 15 are disposed at the upper terminal end of upper portion 28 with an inner center tube 74 and a plurality of seal units 76 forming an outer conduit 78. Inner center tube 74 and outer conduit 78 form a fluid passageway 80 which extends from setting tool 72 at its upper end to a crossover tool 130 at its lower end. Seal units 76 include an upper set of seal units 84 adjacent setting tool 72, a medial set of seal units 86 above crossover tool 130, and a lower set of seal units 88 which extends downwardly from crossover tool 130. Lower portion 90 is connected to upper portion 28 at the lower terminal end of lower seal units 88 by a connection means 95. Connection means 95 includes a downwardly projecting pin member 92 on the lower terminal end of upper portion 28 and a receptacle or box 94 disposed at the upper terminal end of lower portion 90. The connection means 95 is described in further detail below with respect to FIG. 4. Lower portion 90 is a wash pipe which includes a closing sleeve shifter 96, a weight-down collet 100, a ported pipe 98, and a lower ball check valve 102 disposed in the lower terminal end of lower portion 90.

Service tool 20 further includes an upper spring loaded ball check 85 provided at the lower terminal end of center tube 74 to prevent the downward flow of fluids through the flowbore 75 of center tube 74. A lower check valve 87 is provided adjacent the upper end of lower seal unit 88 to prevent the downward flow of fluids in fluid passageway 80 and into the flowbore 89 formed by those lower seal units 88 which are disposed below crossover tool 130.

Alternatively, cross-over tool 130 may be a part of the lower portion 90 with the connection means 95 disposed above cross-over 130 between adjacent sections of inner center tube 74 and outer conduit 78 between the upper set of seal units 84 and the medial set of seal units 86. Connection means 95 may be in the form of a latch (not shown) for suspending the lower portion 90 within outer completion string 10 at its lower end. A work string is attachable to the latch for raising the lower portion 90 within the completion string 10. The latch is removable so that after the lower portion is raised, the latch may be removed for connecting the sections forming the upper portion 28.

Referring now to FIG. 3, service tool 20 is shown disposed within completion string 10. In the position shown in FIG. 3, all of the closing sleeves 32, 52, are shown in the closed position. The closing sleeve shifter 96 and weight-down collet 100 are disposed below all of the closing sleeves 32, 52 and indicator collars 34, 54. Work string 15 forms an annulus 23 with outer casing 18 for fluid communicating with the surface.

Figure 4:
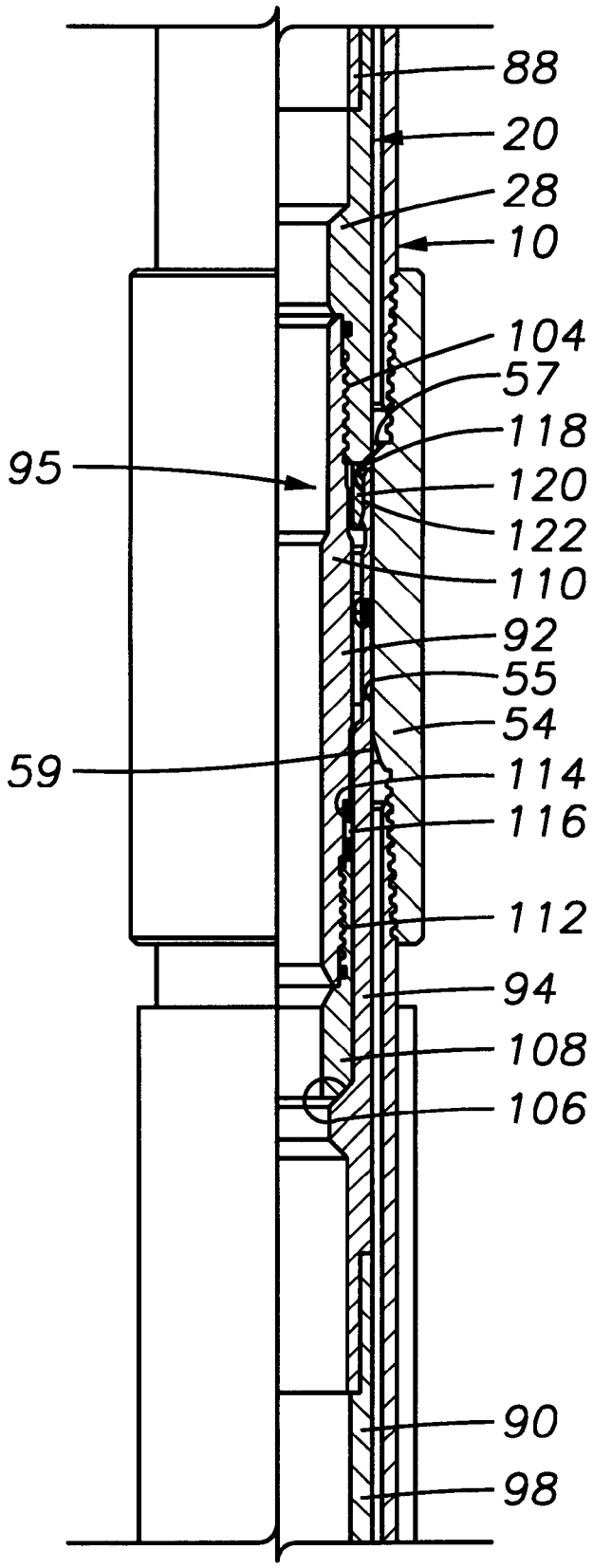
FIG. 4 is a cross-sectional view of the connection of two parts of the service tool.

Referring now to FIG. 4, the connection means 95 connects the upper portion 28 of service tool 20 to the lower portion 90 of service tool 20. The connection means 95 includes a pin member 92 threaded at 104 to the lower terminal end of seal units 88 and a receptacle or box 94 disposed on the upper terminal of wash pipe 98. Box 94 includes an inwardly projecting annular shoulder 106 which engages the nose 108 of pin member 92. Pin member 92 includes a double male threaded connector member 110 threaded at 104 and threaded at 112 to nose member 108. Connector member 110 includes a reduced diameter portion 114 on which is housed a seal member 116 which sealingly engages the inside diameter of box member 94. The upper terminal end of box 94 includes internal threads 118 which engage external threads 122 on a split ring 120 housed on pin member 92. Upon assembly, pin member 92 is received within box 94 and rotated to threadingly engage threads 118, 122 on box 94 and ring 120, respectively.

Also shown in FIG. 4 is lower zone indicator collar 54. Indicator collar 54 includes a reduced diameter portion 55 forming an upwardly facing support shoulder 57 and a downwardly facing cam shoulder 59. Indicator collar 54 is adapted to support the load shoulder 222 on weight-down collet 100, as hereinafter described, so as to provide an indication of the position of the service tool 20 with respect to completion string 10. It should be appreciated that upper zone indicator collar 34 is substantially the same as lower zone indicator collar 54.

Figure 5:
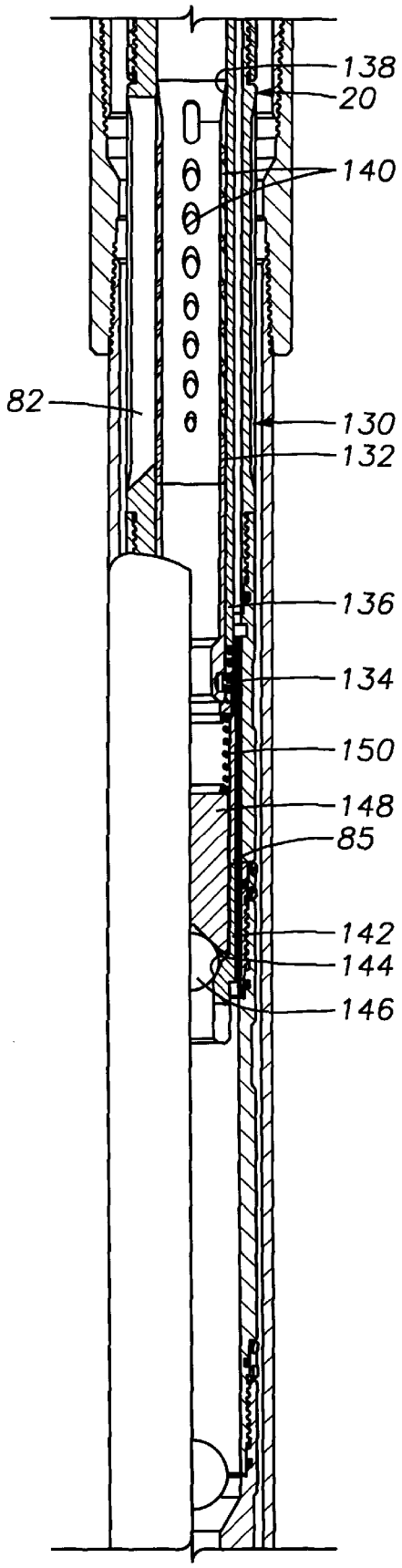
FIG. 5 is a vertical cross-sectional elevation view of the crossover tool with tungsten carbide sleeve and a spring loaded check valve.

Referring now to FIG. 5, a crossover tool 130 is shown which includes crossover ports 82 for the passage of the gravel slurry through the wall of service tool 20. Crossover tool 130 also includes a protective sleeve 132, preferably made of tungsten carbide, which is secured within crossover tool 130 by a set screw 134 which extends laterally through protective sleeve 132 and into the tubular body 136 of crossover tool 130. Protective sleeve 132 extends axially upward past the crossover ports 82 and crossover tool 130. The upper end of sleeve 132 includes a transition surface 138. Sleeve 132 includes a plurality of openings or flow ports 140 which are circumferentially aligned with the crossover ports 82. Further details of the crossover tool 130 are disclosed in U.S. patent application Ser. No. 08/529,769, filed Sep. 18, 1995 and entitled "Abrasive Slurry Delivery Apparatus and Methods of Using Same", incorporated herein by reference.

Also shown on FIG. 5 is the upper spring loaded ball check 85. Ball check 85 includes a generally cylindrical body 142 having an inwardly extending annular seat 144 which supports a sphere 146. An inner member 148 is biased downwardly by spring 150 against sphere 146. Ball check 85 prevents downward flow through the flowbore 75 of inner center tube 74 but becomes unseated upon the upward flow of well fluids having sufficient pressure to compress spring 150 and allow fluid flow around sphere 146 as it becomes unseated from seat 144.

Figure 6:
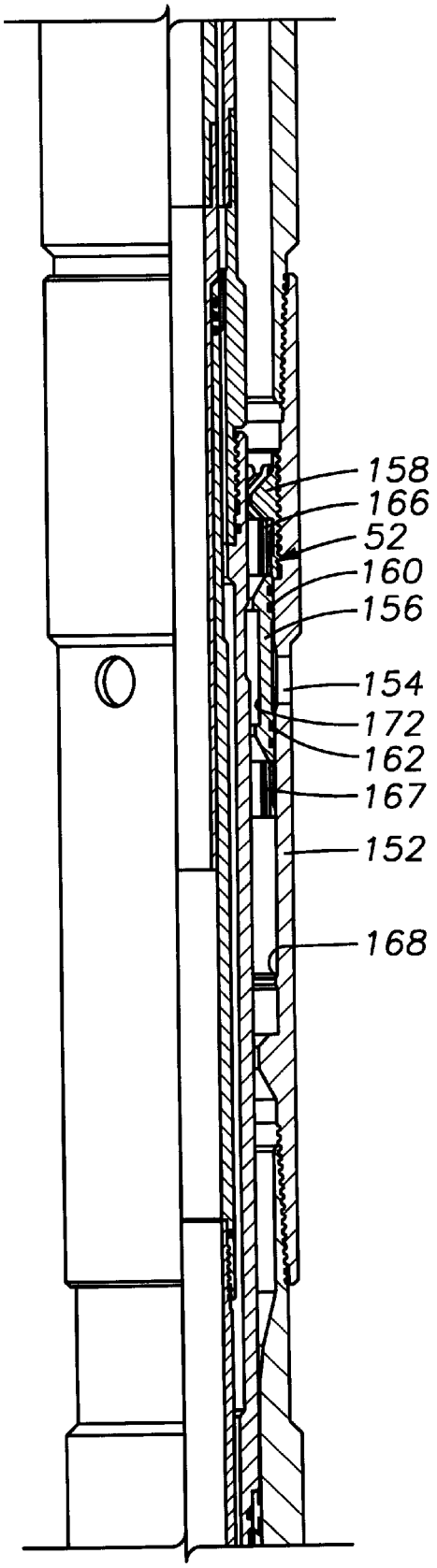
FIG. 6 is a vertical cross-sectional elevation view of a closing sleeve.

Referring now to FIG. 6, there is shown lower zone, upper closing sleeve 52. Closing sleeve 52 is identical in operation to upper zone, closing sleeve 32. Closing sleeve 52 includes a tubular body 152 having a plurality of apertures or flow ports 154 circumferentially spaced around body 152. A closure member 156 is reciprocably disposed on tubular body 152. Closure member 156 includes a plurality of upwardly and downwardly projecting fingers 166, 167, respectively, and upper and lower sets of sealing members 160, 162, respectively, for sealingly engaging the inside diameter of tubular body 152 for closing and sealing ports 154. In the upper and closed position of closure member 156, the upper terminal ends of upper fingers 166 engage a release ring 158. Release ring 158 is fluted for fluid flow. In the lower and open position, the lower fingers 167 pass over annular detent 168 allowing ports 154 to be open for fluid flow. The lower end of closure member 156 abuts detent 168. Closure member 156 further includes an inner enlarged diameter channel 172 for cooperatively receiving a latch member 174 on closing sleeve shifter 96 hereinafter described.

Figure 7:
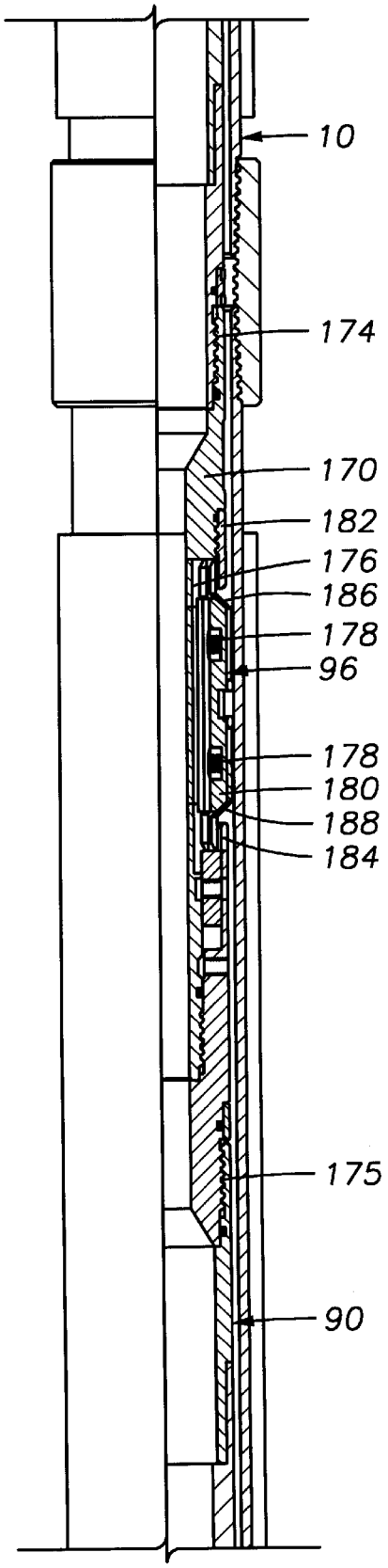
FIG. 7 is a vertical cross-sectional elevation view of a closing sleeve shifter.

Referring now to FIG. 7, there is shown closing sleeve shifter 96. Closing sleeve shifter 96 includes a tubular body 170 having threads 174, 175 on each end for threaded engagement in wash pipe 90. Tubular body 170 includes a reduced diameter portion 176 for receiving a plurality of latch members 180 which are biased outwardly by spring members 178. Latch members 180 are maintained within the channel formed by reduced diameter 176 by retainer 182 at the upper end and retainer 184 at the lower end, retainers 182, 184 being attached to tubular body 170. Latch members 180 include tapered shoulders 186, 188 for camming latch members 180 inwardly upon engaging a shoulder on completion string 10. Closing sleeve shifter 96 is located below connection means 95 on the lower portion 90 of service tool 20.

Figure 8:
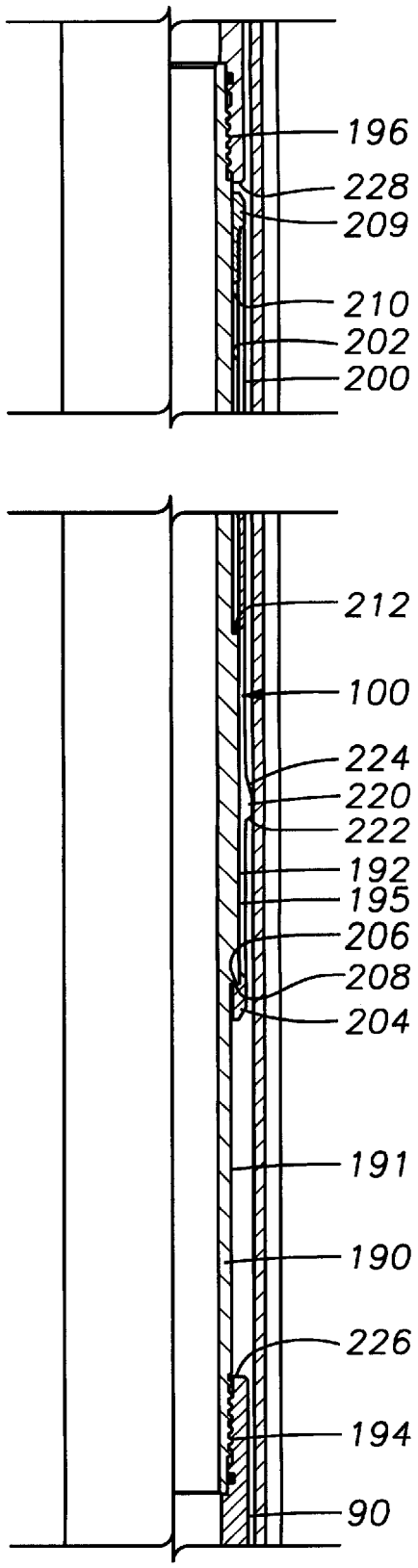
FIG. 8 is a vertical cross-sectional elevation view of a weight-down collet.

Referring now to FIG. 8, there is shown weight-down collet 100. Weight-down collet 100 includes a tubular body 190 having an enlarged diameter annular boss 192 forming a downwardly facing shoulder 208 and an upwardly facing shoulder 212. Tubular member 190 is threaded at 194 at its lower end and at 196 at its upper end for connection within lower portion 90. A sliding sleeve 200 is reciprocably and slidably mounted around tubular body 190 and includes an enlarged diameter portion forming an inner annular channel 202 which, in the assembled position, receives annular boss 192. The lower end of body 190 is formed by a plurality of fingers 195, having slots therebetween, allowing fingers 195 to be bowed or collapsed inwardly. Sliding sleeve 200 includes an inwardly directed flange 204 at its lower terminal end forming an upwardly facing annular shoulder 206 for abutting engagement with the downwardly facing shoulder 208 formed by annular boss 192. A collar 209 is threaded on the upper terminal end of sliding sleeve 200 thereby forming a downwardly facing annular shoulder 210 adapted for engaging upwardly facing annular shoulder 212 on the upper end of annular boss 192. Adjacent the lower terminal end of sliding sleeve 200 is an outwardly extending annular shoulder 220 forming a downwardly facing annular load shoulder 222 and an upwardly facing and downwardly and outwardly tapering shoulder 224 at its upper end. The threaded connections at 194, 196 form shoulders 226, 228. Sliding sleeve 200 is free to slidingly reciprocate on annular boss 192 of tubular body 190.

Figure 9:
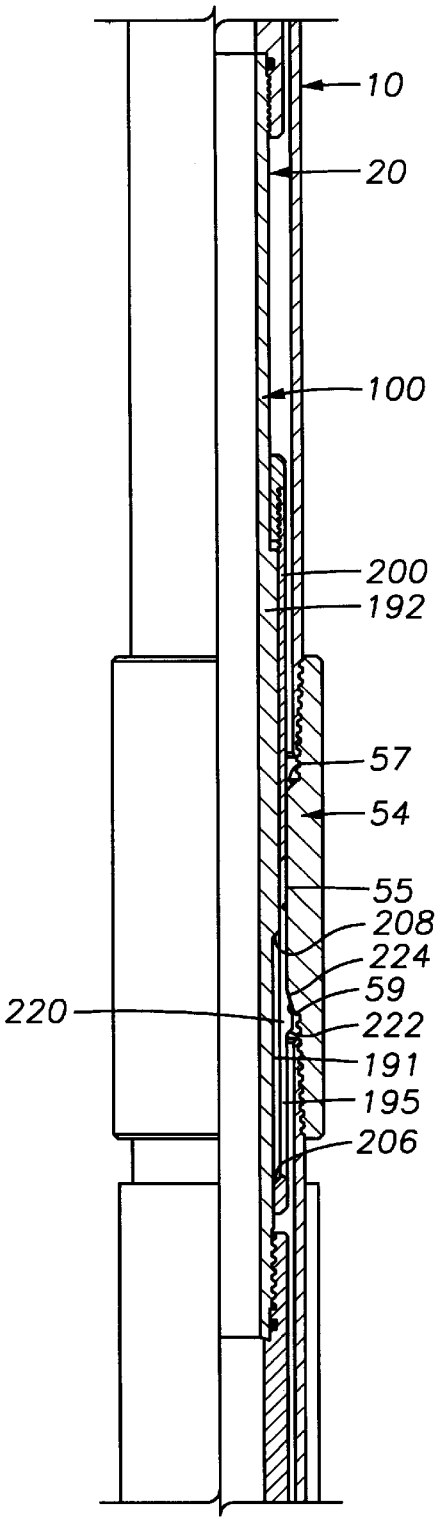
FIG. 9 is a vertical cross-sectional elevation view of the service string raised within the completion string just prior to the weight-down collet passing beneath the indicator collar.
Figure 10:
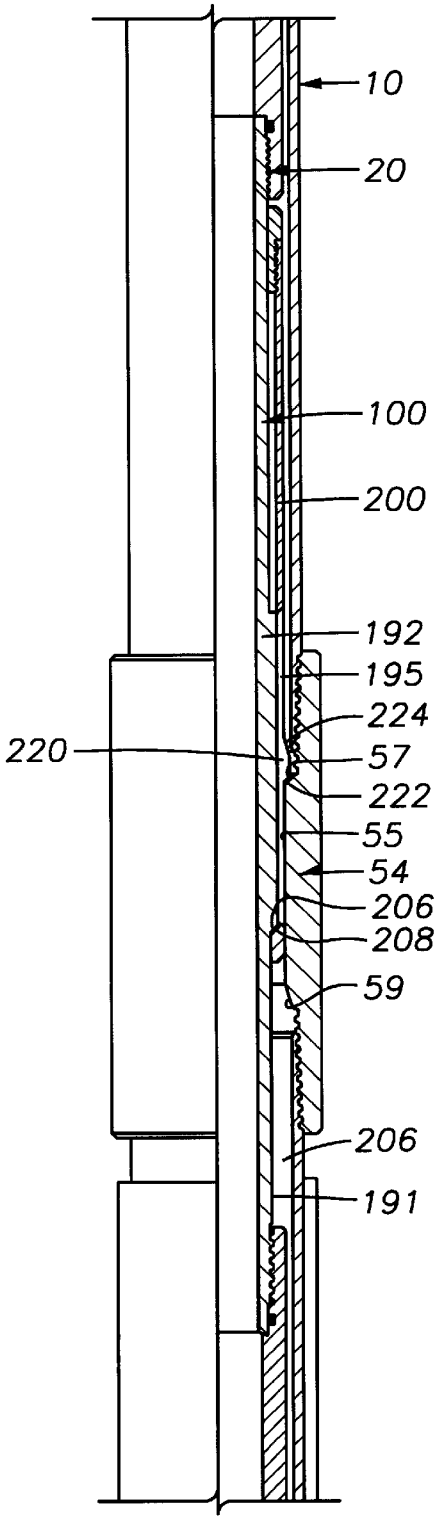
FIG. 10 is a vertical cross-sectional elevation view of the weight-down collet in engagement with the support shoulder of the indicator collar allowing weight to be placed on the service string to set down on the indicator collar of the completion string.

Referring now to FIGS. 9 and 10, the weight-down collet 100 is designed so that it may pass upwardly through an inwardly projecting restriction on completion string 10, such as the reduced diameter portion 55 of indicator collars 34, 54, but not past back downwardly through such a restriction so that a predetermined portion of the weight of service string 20 and work string 15 may be supported by the support shoulder 57 of indicator collars 34, 54. In operation, sliding sleeve 200 has an upper position shown in FIG. 10 whereby upwardly facing annular shoulder 206 on sleeve 200 abuttingly engages downwardly facing annular shoulder 208 on boss 192. In this uppermost position, annular boss 192 is aligned directly behind fingers 195 on which is disposed annular shoulder 220 with downwardly facing load shoulder 222. Annular boss 192 prevents fingers 195 from being bowed or collapsed inwardly thereby allowing load shoulder 222 to engage support shoulder 57 on reduced diameter portion 55 of indicator collars 34, 54. In the lowermost position shown in FIG. 9, fingers 195 are positioned over the reduced diameter portion 191 of tubular body 190 thereby allowing the fingers 195 to collapse inwardly upon annular shoulder 220 engaging a restriction on completion string 10 as service tool 20 passes upwardly through completion string 10. However, once the weight-down collet 100 has passed through the reduced diameter portion 55 of one of the indicator collars 34, 54, the sleeve 200 on weight-down collet 100 moves to its uppermost position as shown in FIG. 10 whereby annular boss on 192 on body 190 maintains the fingers 195 in their outermost position such that part of the weight of the service tool 20 and work string 15 may be supported by the completion string 10.

The weight-down collet 100, like closing sleeve shifter 96, is disposed on the lower portion 90 of service tool 20 below connection means 95. Since the weight-down collet 100 cannot be lowered through one of the indicator collars 34, 54, it must be disposed within completion string 10 prior to one of the indicator collars 34, 54, being assembled within the well on completion string 10. Thus, the weight-down collet 100 is placed inside the completion string 10 prior to any of the indicator collars 34, 54 or other restrictions within the flowbore 17 of the completion string 10, being assembled within the completion string 10.

It should be appreciated that the present invention is not limited to a single position weight-down collet which only allows the operator to raise the weight-down collet up through an indicator collar once and then set back down. A multi-position indicator collet such as the multi-position indicator collet shown and described in U.S. Pat. No. 4,722,392, issued Feb. 2, 1988, incorporated herein by reference, may be used in place of the single position weight-down collet. The single position weight-down collet is preferred since the single position weight-down collet can be used to support more weight than an unsupported multi-position indicator collet. In particular, during a frac pack operation, a large amount of weight may need to be supported by the weight-down collet to withstand the amount of tubing movement caused by the frac pack operation so as to maintain the service string 20 in position with respect to completion string 10. Substantial loads such as up to 100,000 pounds may be required to prevent the weight-down collet from being lifted off of the indicator collar. A single position weight-down collet may support up to 100,000 pounds of weight. The single position weight-down collet will not pass down through the indicator collar unless its mechanical limits are exceeded causing it to break. However, it is impractical to use a multi-position indicator collet which would support a substantial load, such as 100,000 pounds, because it would require that a large percentage of that 100,000 pounds be applied to raise the multi-position indicator collet up through a restriction in the completion string.

Prior to the assembly of the multi-zone gravel pack assembly, the sump packer is run into the well on a wire line and set at a predetermined location prior to assembling the completion string 10 and service tool 20. The completion string 10 and service tool 20 are then assembled on the rig floor at the surface. The completion string 10 is assembled by inserting completion string 10 into the well at the surface, section by section, starting at the lower end of the completion string. As each section is added to the completion string 10, the top of the string is supported at the wellhead by slips which are set around the completion string 10. As distinguished from the prior art, prior to attaching that section of the completion string 10 which includes the lowermost closing sleeve, such as lower closing sleeve 52, and lowermost indicator collar, such as lower indicator collar 54, the lower portion 90 of the service tool 20 is assembled and lowered into that portion of the completion string 10 which extends below the lowermost closing sleeve and indicator collar. The lower portion 90 of the service tool 20 is either supported by a restriction in the sealing assembly 66 on the lower end of completion string 10 or by a retractable "no-go" such as a reverse indicator. The remaining sections of the completion string 10 are then attached until the completion string 10 is assembled up to the production packer 30 which is connected after completing the assembly of the completion string 10 and service tool 20.

After the completion string 10 is assembled, the upper portion 28 of service tool 20 is assembled beginning with lower seal units 88 having pin member 92 at its terminal end. After lower seal units 88 have been assembled, the outer concentric conduit 78 of the crossover tool 130 is assembled and lowered into completion string 10 and then the inner smaller center tube 74 is lowered into outer conduit 78 to complete the assembly of the upper portion 28 of service tool 20.

Upon completing the assembly of upper portion 28, pin 92 on its lower end is inserted into receptacle or box 94 on the upper terminal end of lower portion 90. Upper portion 28 is then inserted and latched into lower portion 90 to connect pin and box 92, 94, respectively, to form connection means 95.

Alternatively, if the cross-over tool 130 is disposed in the lower portion 90, the lower portion 90 includes a releasable latch at its upper end. The lower portion 90 with latch is lowered and suspended by the latch at the lower end of outer completion string 10 prior to attaching that section of completion string 10 which includes the lowermost closing sleeve and lowermost indicator collar. The remaining sections of the completion string 10 are then attached until the completion string 10 is fully assembled. A work string is then lowered into inner service string 20 and attached to the latch at the upper end of lower portion 90. The lower portion 90 is then raised until the lower portion of service string 20 is aligned and supported within completion string 10. The latch is then removed so as to eliminate leaving the connection means in the well and the remaining sections of the upper portion 28 are assembled to complete the assembly of inner service string 28 as previously described.

By locating the closing sleeve shifter 96 in lower portion 90 and inserting lower portion 90 into the lower portion of completion string 10 as completion string 10 is assembled, the lower portion 90 with closing sleeve shifter 96 is not lowered through the assembled completion string 10 so as to open all the closing sleeves as it passes down the completion string. Thus, the completion string 10 may be assembled with all of the closing sleeves, such as sleeves 32, 52, in the closed position and the service tool 20 may be assembled and disposed within completion string 10 without passing the closing sleeve shifter 96 downwardly past the closing sleeves 32, 52 moving them to the open position as in the prior art.

Once both the completion string 10 and service tool 20 have been assembled up to the production packer assembly and are suspended at the surface, the completion string 10 and service tool 20 are raised for connection with the production packer 30 and setting tool 72. Seal units 84, 86 and 88 on service tool 20 are located with respect to seal bores 38, 40, 58 and 60 such that well fluids are allowed to pass into the annular area 65 best shown in FIG. 3 as the assembly of the completion string 10 and service tool 20 are lowered into the casing 18. If the annulus is sealed between upper and lower seal bores 58, 60, ambient pressure would become trapped in this annular space creating a pressure differential which could cause the pipes to collapse under hydrostatic pressure. Tools are positioned with seals 86 below seal bore 58 to prevent this from happening. The completion string 10 and service tool 20 are lowered as a unit into the well and supported on sump packer 70. At that time, upper and lower screens 36, 56 are located adjacent each of the upper and lower production zones 14, 12, respectively. A sphere (not shown) is then dropped through work string 15 and production packer 30 is set by pressuring up the work string 15. Upon setting production packer 30, slips 26 are also set such that the completion string 20 is supported and sealed within outer casing 18.

The setting tool 72 with service tool 20 is then disconnected from outer completion string 10. Once the cross over ports 82 are positioned within the pup extension 62 and prior to opening lower zone lower closing sleeve 52, the flowbore 75 of work string 15 is again pressured up to set isolation packer 50. Service tool 20 is then picked up and raised within completion string 10 to begin the treatment of production zones 12, 14, such as by gravel packing. In raising service tool 20, closing sleeve shifter 96 passes through lower zone lower closing sleeve 52 and weight-down collet 100 passes through lower zone indicator collar 54 with fingers 195 on collet 100 collapsing inwardly so as to allow shoulder 220 to pass beneath reduced diameter portion 55 of lower zone indicator collar 54. Service tool 20 is then moved back downwardly with latch members 180 engaging closure member 156 of sleeve 52 and moving closure member 156 to its lower position thereby opening ports 154 and allowing fluid communication with annulus 24. Also upon lowering the service tool 20 back down, load shoulder 222 of weight-down collet 100 is engaged and supported by support shoulder 57 on indicator collar 54. Further, the seals on setting tool 72 no longer engage upper zone upper seal bore 38 adjacent production packer 30 thereby opening a ported sub for communication between upper annulus 23 and fluid passageway 80 formed by inner center tube 74 and outer conduit 78. In this position, the upper set of seal units 84, the medial set of seal units 86, and the lower set of seal units 88 sealingly engage upper zone upper seal bore 38, lower zone upper seal bore 58, and lower zone lower seal bore 60, respectively. Crossover ports 82 of crossover tool 130 are now adjacent the apertures 154 through lower zone lower closing sleeve 52 which had been previously been opened by closing sleeve shifter 96. No seals or seal bores are provided below lower zone screen 56.

The weight supported by load shoulder 57 on indicator collar 54 is determined by a weight indicator (not shown) at the surface which indicates the amount of weight of the work string 15 and service tool 10 which is supported by the crown block on the drilling rig at the surface. The weight indicator provides the operator a means of determining the location of the service tool 20 with respect to the completion string 10 since as long as the indicator collar is supporting weight from the service tool 20, the gravel pack ports 82 of crossover tool 130 are properly positioned adjacent the apertures 154 in the closing sleeve. The weight applied to the tool 20 changes as the length of the string changes. When the length of the work string 15 shortens, load is removed from the weight-down collet 100 which indicates that the work string 15 is shrinking. This tendency for the working string 15 to move upwardly reduces the load on the weight-down collet 100. If the work string 15 shortens too much as indicated by the weight indicator, a lowering of the work string 15 applies additional weight on service tool 20 to compensate for the shrinkage in length. Additional weight may be placed on the weight-down collet 100 by slacking off on the work string 15 thus allowing the work string 15 to be lowered until the weight indicator indicates that there is again a predetermined amount of weight on the weight-down collet 100. By slacking off on the work string 15, weight is transferred from the crown block on the rig at the surface to the support shoulder 57 on indicator collar 54 on completion string 10 downhole.

Although a gravel packing operation is being described, it should be appreciated that the present invention may be used for other methods of treating the well such as a fracturing operation. Treating the well in a weight-down position is particularly important in a fracturing operation since the work string 15 can shrink several feet during such an operation. In a prior art operation, if the work string 15 were to move upwardly several feet, it would be possible for the gravel pack ports and the service tool to be raised into the seal bore above the isolation packer thereby prematurely ending the operation.

In gravel packing the lower zone 12, gravel slurry is pumped down the flowbore 75 formed by work string 15 and center tube 74. The ball check valve 85 directs the gravel through crossover ports 82 and through the opened apertures 154 in lower closing sleeve 52 and into lower annulus 24. The gravel builds in lower annulus 24 adjacent sump packer 70 with the returns flowing through lower zone screen 56 and ported sub 98. The returns flow up flowbore 89 of lower seal units 88 and through lower ball check valve 87. The returns then pass through the bypass apertures in crossover tool 130 around crossover ports 82 and up fluid passageway 80. The returns then flow out through the open ported sub adjacent the setting tool 72 and up upper annulus 23 formed by work string 15 and casing string 18. Upon completing the gravel pack of the lower production zone 12, fluids are reverse circulated down to the crossover ports 82. Fluid is pumped down the annulus 23 between work string 15 and casing 18, through the ported sub and then flows up through upper ball check 85 and flowbore 75 to the surface.

The extension of the fluid passageway 80, formed by upper seal units 38 and center tube 74 between crossover ports 82 to a point above production packer 30, prevents any returns from flowing into an upper production zone. Further, this fluid passageway 80 and upper ball check 85 at the lower end of center tube 74 allow reverse flow through the service tool 20 without any requirement for a wash string from the surface.

In gravel packing the upper production zone 14, the service tool 20 is raised within completion string 10 and then moved downwardly as previously described. In particular, closing sleeve shifter 96 latches with upper zone, upper closing sleeve 32 and moves it to its lower open position. Further, weight-down collet 100 allows weight to be set on work string 15 to ensure that crossover ports 82 are properly positioned adjacent the apertures in upper zone upper closing sleeve 32. In this position, the upper set of seal units 84, the medial set of seal units 86, and the lower set of seal units 88 sealingly engage upper zone upper seal bore 38, upper zone lower seal bore 40, and lower zone lower seal bore 60. The gravel slurry is then pumped down work string 15 and out through ports 82 and closing sleeve 32 to gravel pack upper zone 14. Circulation and reverse circulation occurs as previously described with respect to the gravel packing of lower production zone 12.

As can be appreciated, the indicator collars, such as collars 34, 54, are set at a predetermined position below each production zone, 12, 14, respectively to ensure that the gravel pack ports 82 are positioned adjacent the appropriate closing sleeve. The distance between the closing sleeve and indicator collar 100 in each set has a predetermined relative distance between the gravel pack ports 82 and the weight-down collet 100 since these must be spaced relative to each other. This allows the gravel pack operation to be performed in a weight-down position as previously described.

The weight-down collet 100 allows the gravel pack ports 82 to be very accurately positioned adjacent the closing sleeve. Further, the weight-down position ensures that the gravel pack ports 82 on the service tool 20 stay properly aligned adjacent with the closing sleeve. The weight-down position is particularly important because it allows the operator at the surface to know that the gravel pack ports 82 remain in the aligned position with the closing sleeve in spite of any movement of the work string.

Although the present method and apparatus have been described for completing a dual zone, the present invention may be used to treat any number of production zones with one trip into the well. The isolation of the upper production zones by the extension of the upper seal units and center tube 74 above production packer 30 allows the production zones to be gravel packed in any sequence, i.e. the production zones do not have to be gravel packed beginning with the lower production zone and then each successive zone above the lower zone. Additional sets of tools are added for each production zone, namely an upper seal bore, a closing sleeve, a lower seal bore, an indicator collar, and production screens with an isolation packer between adjacent sets. Therefore, in a multi-zone operation having more than three production zones, multiple isolation packers are used. Where multiple isolation packers are used, the service tool 20 is raised up the completion string 10 and each isolation packer is set as the service tool 20 is moved up hole. With all of the closing sleeves run in the closed position, each of the isolation packers can be set and subsequently opened as needed by raising the closing sleeve shifter 96 upward through an individual closing sleeve and then setting back down to open the closing sleeve.

Although a single position weight-down collet requires that the production zones be treated beginning with the lowermost zone and moving upwards, a multi-position weight-down collet may be used which allows the method and apparatus of the present invention to treat or produce the individual production zones in any order. In doing so, the closing sleeve shifter 96 is raised upwardly to set each of the isolation packers and then lowered back downwardly to open the closing sleeve for the particular production zone to be treated or produced. At that time, it does not make any difference that the closing sleeve shifter passes downwardly through and opens a closing sleeve since the isolation packers at that time will already have been set.

While a preferred embodiment of the invention has been shown and described, modifications thereof can be made by one skilled in the art without departing from the spirit of the invention.

I claim:

1. A method of assembling an apparatus for individually treating a plurality of production zones in a well comprising the steps of:

assembling a first length of an outer string;

assembling a first length of an inner string having a closing member adapted for opening aperture members to open apertures in the outer string;

inserting the first length of the inner string into the first length of the outer string;

assembling a second length of the outer string that includes apertures and aperture members for opening and closing the apertures;

assembling a second length of the inner string;

inserting the second length of the inner string into the outer string; and operably connecting the first and second lengths of the inner string.

2. The method of claim 1 further including the step of assembling an isolation packer between first and second sets of screens and aperture members in the outer string.

3. The method of claim 1 further including the steps of:

assembling a load member in the first length of the inner string; and assembling a support member in the outer string which is adapted for supporting the load member and inner string.

4. The method of claim 3 further including the step of assembling an isolation packer between adjacent sets of screens, aperture members and support members.

5. The method of claim 1 wherein said first length of outer string does not include any aperture members for opening and closing apertures in the outer string.

6. An apparatus for individually treating a plurality of production zones in a well comprising:

an outer string having a screen and a closing sleeve for each of the production zones to be treated;

an inner string disposed within said outer string and having a cross-over tool and a closing sleeve shifter;

said closing sleeve shifter being initially disposed below said closing sleeves; and said at least one closing sleeve being in a closed position.

7. The apparatus of claim 6 wherein said inner string includes an upper and lower portion connected by a connection, said closing sleeve shifter being disposed on said lower portion.

8. The apparatus of claim 6 wherein each said set of said outer string further includes an indicator collar and said inner string includes a weight-down collet disposed below all of said indicator collars on said outer string.

9. The apparatus of claim 6 further including an isolation packer disposed between each adjacent set of a screen and closing sleeve.

10. An apparatus for individually treating a plurality of production zones in a well comprising:

an outer string having a plurality of sets of screens and support members for each of the production zones to be treated;

an inner string disposed within said outer string and having a crossover tool and a load member; and said load member being disposed below said support members.

11. The apparatus of claim 10 further including an isolation packer disposed between each adjacent set of screens and support members.

12. An apparatus for individually treating at least three production zones in a well, comprising:

a completion string having a set of a closing sleeve, a support member and screen for each production zone to be treated; and a service tool disposed within said completion string and including a cross-over tool, closing sleeve and load member.

13. The apparatus of claim 12 wherein said closing sleeves are in a closed position.

14. The apparatus of claim 12 wherein each said support member includes a support shoulder for supportingly engaging a load shoulder on said load member.

15. The method of claim 14 further including the step of selectively adjusting the weight on the support shoulder to maintain a cross-over tool on the service tool at a predetermined position relative to the closing sleeve.

16. The apparatus of claim 12 further including an isolation packer disposed between each adjacent set.

17. The apparatus of claim 12 wherein said service tool includes an upper and lower portion, said closing sleeve shifter and load member being disposed on said lower portion.

18. A method of assembling an apparatus for individually treating a plurality of production zones in a well comprising the steps of:

assembling a first length of an outer string;

assembling a first length of the inner string having a load member adapted for being supported on a support member in the outer string;

inserting the first length of the inner string into the first length of the outer string;

assembling a second length of the outer string that includes at least one support member for supporting the inner string;

assembling a second length of the inner string;

inserting the second length of the inner string into the outer string; and connecting the first and second lengths of the inner string.

19. The method of claim 18 wherein said first length of outer string does not include any support member for supporting an inner string.

20. A method of treating multiple production zones in a well comprising the steps of:

(a) disposing in the well a completion string with a service tool inside the completion string;

(b) locating a set of screens, closing sleeve, and indicator collar on the completion string adjacent each of the production zones to be treated with an isolation packer disposed between each set and at least one of the closing sleeves being in a closed position;

(c) setting a lowermost isolation packer on the completion string;

(d) raising the service tool allowing a closing sleeve shifter on the service tool to open a lowermost closing sleeve and passing a weight-down member through a lowermost support member;

(e) setting weight of the service tool and work string supporting the service tool onto a support shoulder adjacent the indicator collar;

(f) treating a lowermost production zone; and (g) repeating steps (d) through (f) for each production zone.

* * * * *